US007549846B2

(12) United States Patent
Dube et al.

(10) Patent No.: US 7,549,846 B2
(45) Date of Patent: Jun. 23, 2009

(54) TURBINE BLADES

(75) Inventors: Bryan P. Dube, Columbia, CT (US); John W. Golan, Amston, CT (US); Randall J. Butcher, Newington, CT (US); Richard M. Salzillo, Plantsville, CT (US)

(73) Assignee: United Technologies Corporation, Hartford, CT (US)

( * ) Notice: Subject to any disclaimer, the term of this patent is extended or adjusted under 35 U.S.C. 154(b) by 756 days.

(21) Appl. No.: 11/197,152

(22) Filed: Aug. 3, 2005

(65) Prior Publication Data

US 2007/0031259 A1 Feb. 8, 2007

(51) Int. Cl.
*F01D 5/14* (2006.01)

(52) U.S. Cl. ..... 416/239; 416/248; 416/193 A

(58) Field of Classification Search ..... 416/193 A, 416/219 R, 220 R, 248, 234, 239, 144, 221; 29/889.21, 889.7, 557
See application file for complete search history.

(56) References Cited

U.S. PATENT DOCUMENTS

| | | | | |
|---|---|---|---|---|
| 5,310,318 | A | 5/1994 | Lammas et al. | |
| 7,121,803 | B2 * | 10/2006 | Gautreau et al. | 416/193 A |
| 2004/0213669 | A1 | 10/2004 | Brittingham | |
| 2005/0135936 | A1 * | 6/2005 | Cherolis et al. | 416/193 A |
| 2005/0254958 | A1 * | 11/2005 | Stone | 416/248 |
| 2006/0073022 | A1 | 4/2006 | Gentile et al. | |

FOREIGN PATENT DOCUMENTS

| | | |
|---|---|---|
| GB | 2151310 | 7/1985 |
| WO | WO 94/12390 | 6/1994 |

* cited by examiner

*Primary Examiner*—Ninh H Nguyen
(74) *Attorney, Agent, or Firm*—Bachman & LaPointe, P.C.

(57) ABSTRACT

A turbine blade is provided for use in a gas turbine engine. The turbine blade has a platform, an airfoil radially extending from the platform, and an attachment portion comprising an asymmetric root neck portion having a higher stress side and a lower stress side. The turbine blade may further have additional material and a compound fillet for dispersing strain in a region where the airfoil overhangs the neck portion.

29 Claims, 5 Drawing Sheets

TURBINE BLADES

STATEMENT OF GOVERNMENT INTEREST

The Government of the United States of America may have rights in the present invention as a result of Contract No. F33657-D-2051-524 awarded by the Department of the Air Force.

BACKGROUND OF THE INVENTION (1) Field of the Invention

The present invention relates to an improved design for a turbine blade to be used in a gas turbine engine.

(2) Prior Art

Referring now to FIG. 1, turbine blades 10 typically used in gas turbine engines include a platform 12, an airfoil 14 extending radially from a first side of the platform, and an attachment or root portion 16 extending from a second side or underside of the platform. The root portion 16 typically includes a dovetail portion with a plurality of serrations and a neck portion between the dovetail portion and the underside of the platform. As shown in FIG. 1, the airfoil 14 may overhang the footprint of the root portion 16. Also formed in the turbine blade 10 is a pocket structure 18, which is typically a cast structure. The neck portion of the attachment or root portion 16 begins just beneath the pocket structure 18 and forms a limiting structure in the sense that significant stresses act in this region—stresses which if not dealt with properly could be the source of cracks and other potential failure modes. Balancing stress concentrations between suction and pressure sides of the neck portion and the stress on the turbine airfoil 14 is highly desirable.

Given the lower speeds and temperatures of low pressure turbine airfoils, the root axial length of the root portion 16 is generally shorter than the airfoil chord axial component. Most low pressure turbine airfoils also have shorter attachment root neck lengths. The overhung airfoil and short neck length create a load path that will concentrate stress in the root in most cases. This is exemplified in FIG. 2. In certain cases, these stresses are unacceptable and a potential source of cracks. The traditional solution to this problem is to increase root axial length, width, and enlarge serration sizes. This traditional solution requires a new disk design and increases weight.

SUMMARY OF THE INVENTION

The turbine blades of the present invention better balance the stress concentrations between the lower stress and higher stress sides of the turbine blade root neck.

In accordance with the present invention, a turbine blade broadly comprises a platform, an airfoil radially extending from the platform, and an attachment portion comprising an asymmetric root neck having a higher stress side and a lower stress side.

Further in accordance with the present invention, there is provided a turbine blade which broadly comprises a platform, an airfoil radially extending from the platform, an attachment portion including a neck portion with a rear root face and a root higher stress side, and means for dispersing strain in a region where the airfoil overhangs the neck portion.

The present invention also relates to a method for providing a turbine blade having balanced stress concentrations between suction and pressure sides. The method broadly comprises the steps of forming a turbine blade having a platform, an attachment portion beneath the platform having a neck portion, and an airfoil portion extending radially from the platform; and adjusting a moment towards a lower stress side of the neck portion.

Other details of the turbine blades of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
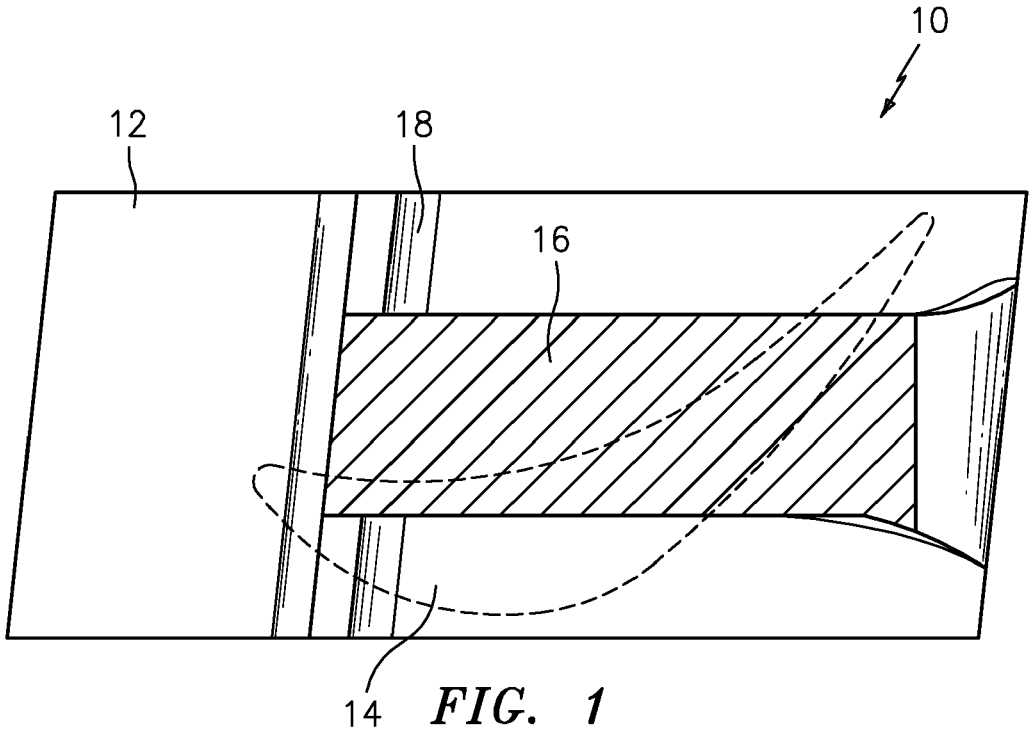
FIG. 1 (PRIOR ART)
FIG. 1 is a bottom view of a prior art turbine blade.
Figure 5:
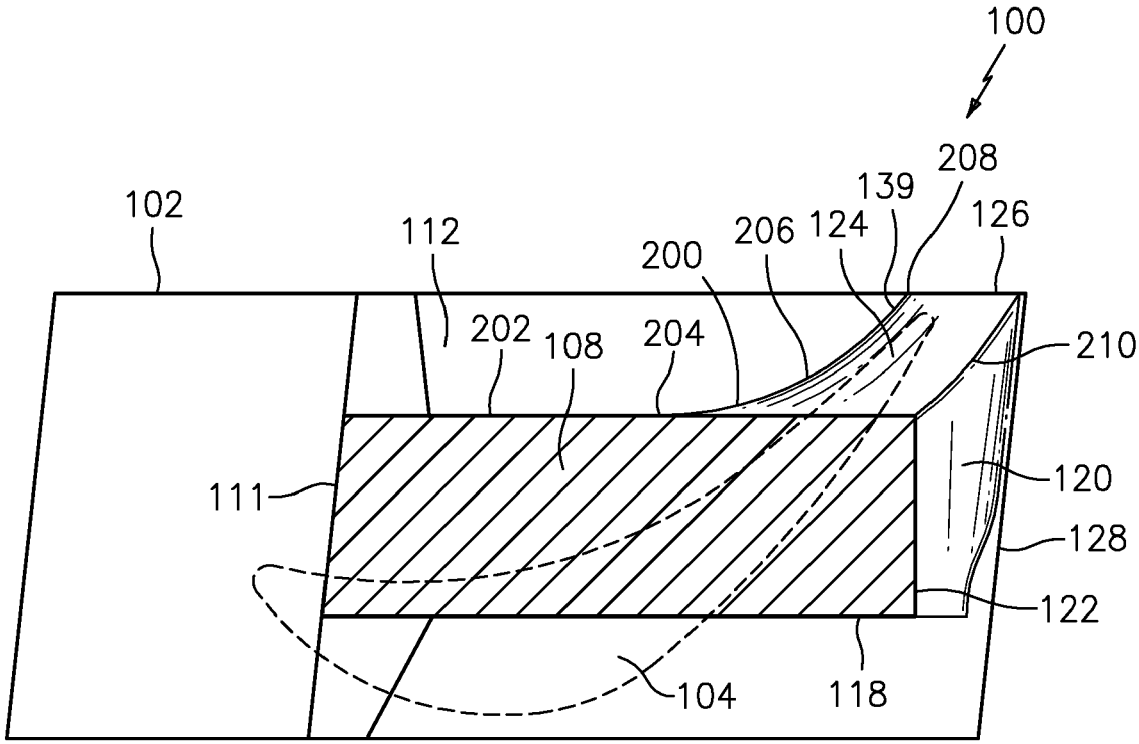
FIG. 5 is a bottom view of a turbine blade in accordance with the present invention.
Figure 2:
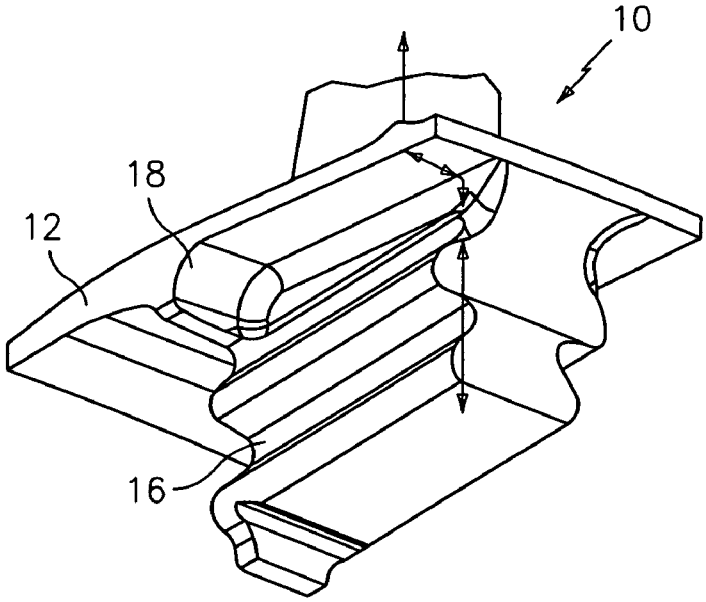
FIG. 2 (PRIOR ART)
FIG. 2 illustrates the load path in prior art turbine blades which concentrates stress in the root of the turbine blade.
Figure 3:
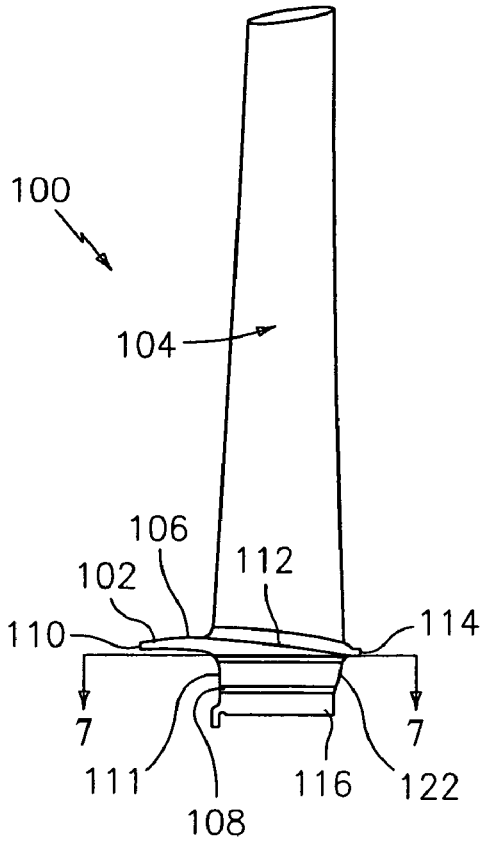
FIG. 3 is a side view of a turbine blade in accordance with the present invention.
Figure 4:
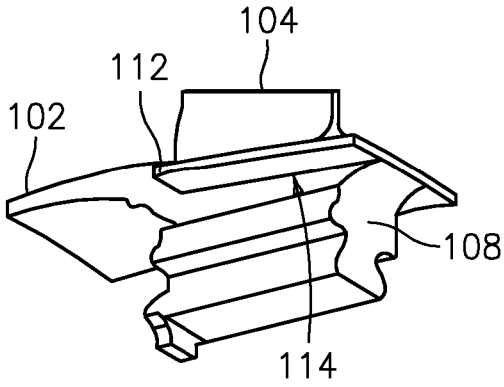
FIG. 4 is an enlarged view of the attachment portion of the turbine blade of FIG. 3.

Referring now to the drawings, FIGS. 3 through 5 illustrate a turbine blade 100 in accordance with the present invention. The turbine blade 100 has a platform 102, an airfoil 104 radially extending from a first side 106 of the platform 102, and an attachment or root portion 108 extending from a second side 110 of the platform 102. A pocket structure 112 is formed in the sides of the platform 102. Just below the pocket structure 112, there is a neck portion 114 that forms part of the root portion 108. The root portion 108 also has a dovetail portion 116 that is used to join the turbine blade 100 to a rotating member (not shown) such as a rotating disk. The root portion 108 has a front root face 111 and a rear root face 122.

As can be best seen from FIG. 5, the airfoil 104 overhangs the footprint 118 of the root portion 108. Referring now to both FIGS. 5 and 9, in order to avoid a concentration of stresses in the root portion 108 of the turbine blade 100, stresses and strain which are caused by the overhung airfoil 104 are dispersed over an increased area. One part of this increased area is formed by additional material 120 along the rear root face 122. The additional material 120 may be a cast material or a deposited material and may be the same material as the material forming the turbine blade 100 or may be a material which is compatible with the material forming the turbine blade 100.

Figure 8:
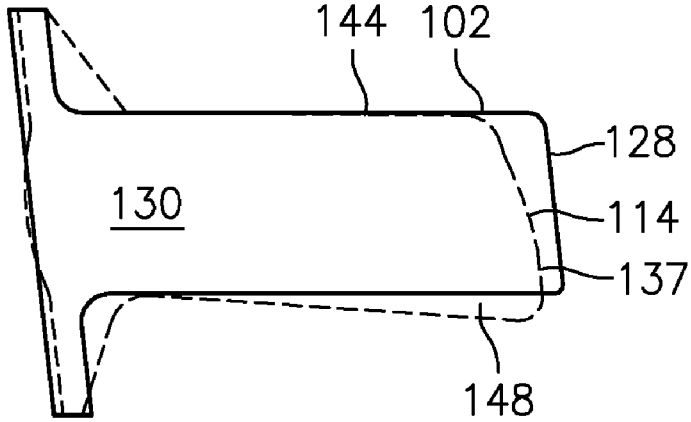
FIG. 8 is a sectional view of the limiting section illustrating the technique for providing an asymmetric root neck in accordance with the present invention.
Figure 9:
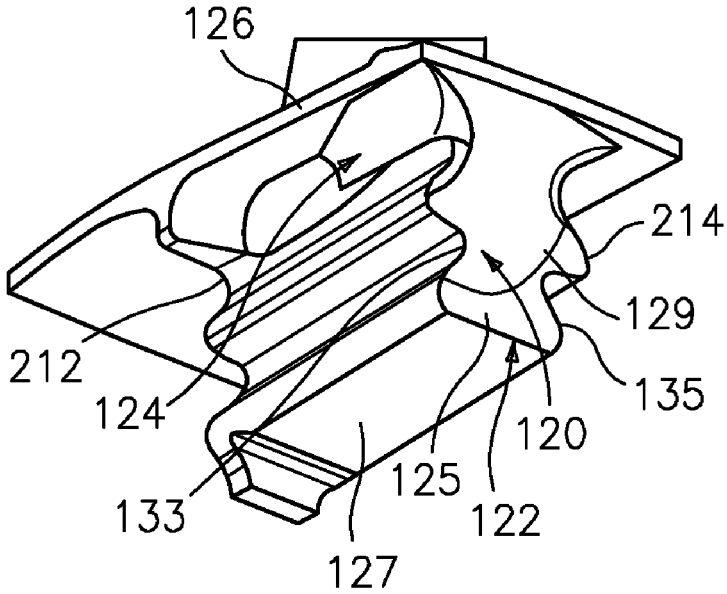
FIG. 9 is a perspective view of the turbine blade of the present invention illustrating the mechanism for dispersing strain at the root neck in accordance with the present invention.

As can be seen from FIG. 9, the rear root face 122 has a planar portion 125 extending from an edge or a surface 127. The leading edge 129 of the additional material 120 begins at a point spaced from the surface 127. The leading edge 129 is preferably arcuately spaced and extends from a first side 133 of the rear root face 122 to a second or opposite side 135 of the rear root face 122. The additional material 120 increases in thickness as it goes from the leading edge 129 to a point where it intersects the second side 110 of the platform 102. This causes the rear root face 122, at the point where it contacts the platform 102 to have a curved, non-linear shape 137 as can be seen in FIG. 8.

Additionally, if desired, the increased area for dispersing the stresses and strains may include a compound fillet 124 beginning at a point 139 at about 88% of the distance between the forward front root face 111 and the trailing edge 128 of the platform 102. The compound fillet 124 is preferably located on the higher stress side 126 of the platform 102. Typically, the higher stress side 126 is the pressure side of the platform. The compound fillet 124 may be a cast structure formed from the same material as that forming the turbine blade 100 or may be a deposited material formed from the same material as, or from a different material compatible with, the material forming the turbine blade 100. The compound fillet 124 may be machined if desired.

The root neck portion 114 preferably has a planar or substantially planar portion 202 extending from the front root face 111 to a point 204 about midway of the distance from the front root face 111 to the trailing edge 128. The upper edge 200 then has an arcuately shaped transition zone 206 which extends from the point 204 to the starting point 208 of the compound fillet 124. As can be seen from FIGS. 5 and 9, the compound fillet 124 may then arcuately extend from the point 139 to a point near, or at, the intersection of the higher stress side 126 of the platform and the trailing edge 128 of the platform. The compound fillet 124 is three dimensional and rises from the planar surface of the second side 110 of the platform 102 to an elevated ridge 210 where it intersects the additional material 120.

As a result of the addition of the additional material 120 and the compound fillet 124, the load may be more dispersed between the pressure side and suction side serrations 212 and 214 through a larger area. Further, the root neck portion 114 is tapered axially producing increased root thickness towards the rear of the root portion 108. This assists in reducing the stiffness in the center of the neck portion 114.

The turbine blade 100 has a maximum stress life limiting section 130 which is an uppermost section of the neck portion 114 just beneath the platform 102. The stress concentrations caused by the overhung airfoil 104 should be balanced between the lower stress side 132 (typically the suction side) and the higher stress side 134 (typically the pressure side) of the limiting section 130.

In accordance with the present invention, the stress load may be redistributed by adjusting the moment of the volume above the limiting section center of gravity (CG) 140 relative to the peak stress area CG 142 without adjusting the volume of the portion of the turbine blade 100 above the limiting section 130. This is done by adjusting the area CG 142 which affects the moment caused by the volume of the portion of the turbine blade above the limiting section. Increasing the moment to the lower stress side greatly reduces the stress on the higher or peak stress side.

Figure 6:
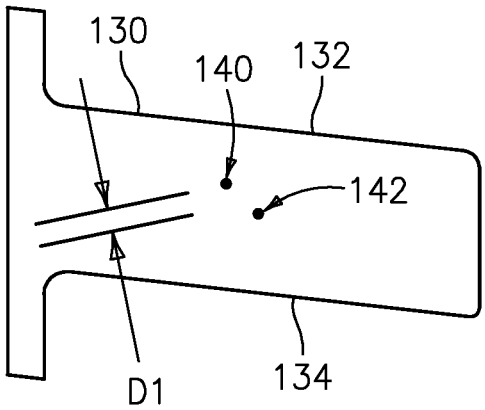
FIG. 6 (PRIOR ART)
FIG. 6 is a sectional view of the limiting section of the prior art turbine blade of FIG. 1.
Figure 7:
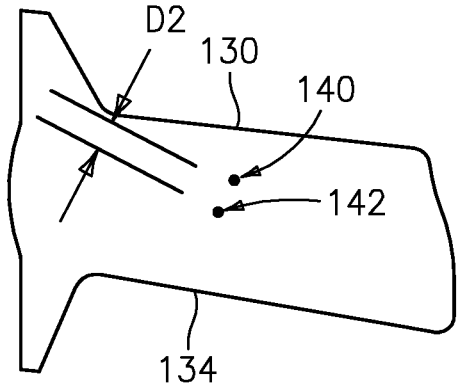
FIG. 7 is a sectional view of the limiting section of a turbine blade of FIG. 3 taken along lines 7-7.

The desired reduction in stress on the peak stress side may be accomplished by taking material away from the lower stress side (suction side) 144 of the limiting section 130 and/or by adding material on the high stress side (pressure side) 146. This is illustrated in FIG. 8 and results in the neck portion 114 being asymmetric. The change in location of the cg of area 142 and the cg of volume above the limiting section 140 can be seen in FIGS. 6 and 7. It can be seen that the distance D2 between the cg of volume 140 and the cg of area 142 in FIG. 7 is greater than the distance D1 between cg of volume 140 and the cg of area 142 in FIG. 6. This indicates the increase in moment to the lower stress side 144.

In one embodiment of the present invention, approximately 0.005 inches of material may be removed from the side 144 in one or more benign stress areas. Further, additional material giving rise to an increase of 0.020 inches may be made to the higher stress or pressure side 146. The additional material may comprise a material which is identical to or compatible with the material forming the turbine blade 100 and may take the form of the compound fillet 124 and the transition zone 206 from the planar or substantially planar portion 202 to the compound fillet 124. As previously noted, this additional material may be a cast material or may be deposited after the turbine blade 100 has been formed.

In practicing the present invention, the material removal from the lower stress or suction side 144 should be balanced with total P (force)/A (area) stress on the airfoil portion 104. Further, the bending moment is preferably moved more towards one side in such a way as to reduce the peak stress on the other side.

The asymmetric nature of the neck portion 114 as a result of the aforementioned modifications is shown in FIG. 8. The asymmetric neck portion 114 of the present invention has particular utility on blades with broach angles.

Figure 10:
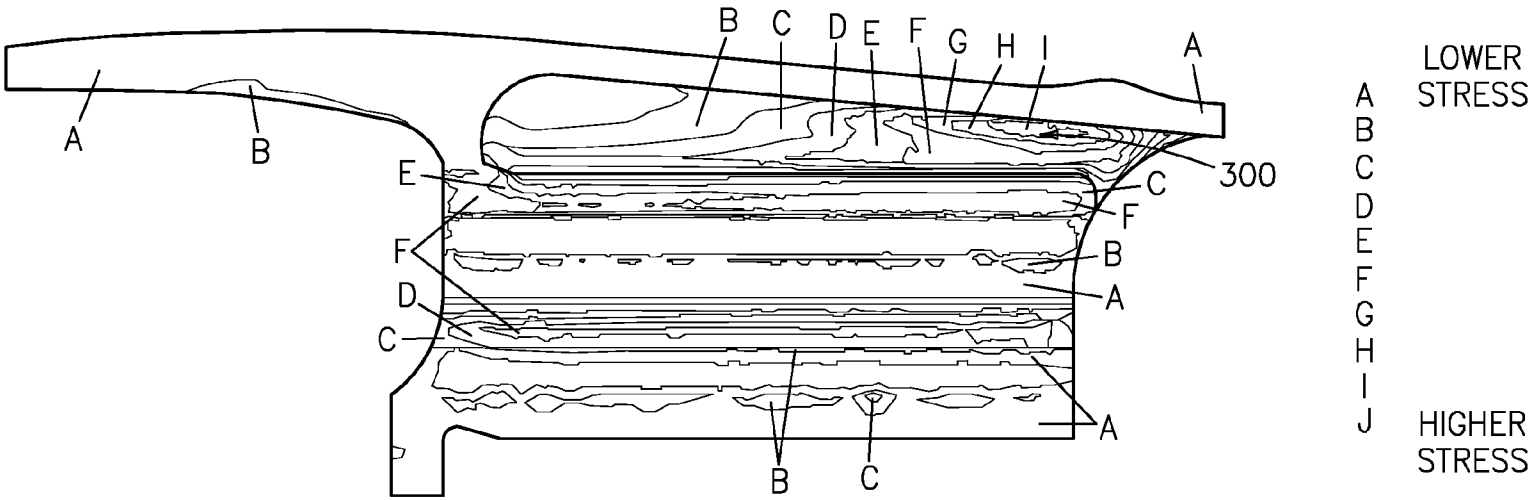
FIG. 10 (PRIOR ART)
FIG. 10 illustrates the stresses acting on a prior art turbine blade.
Figure 11:
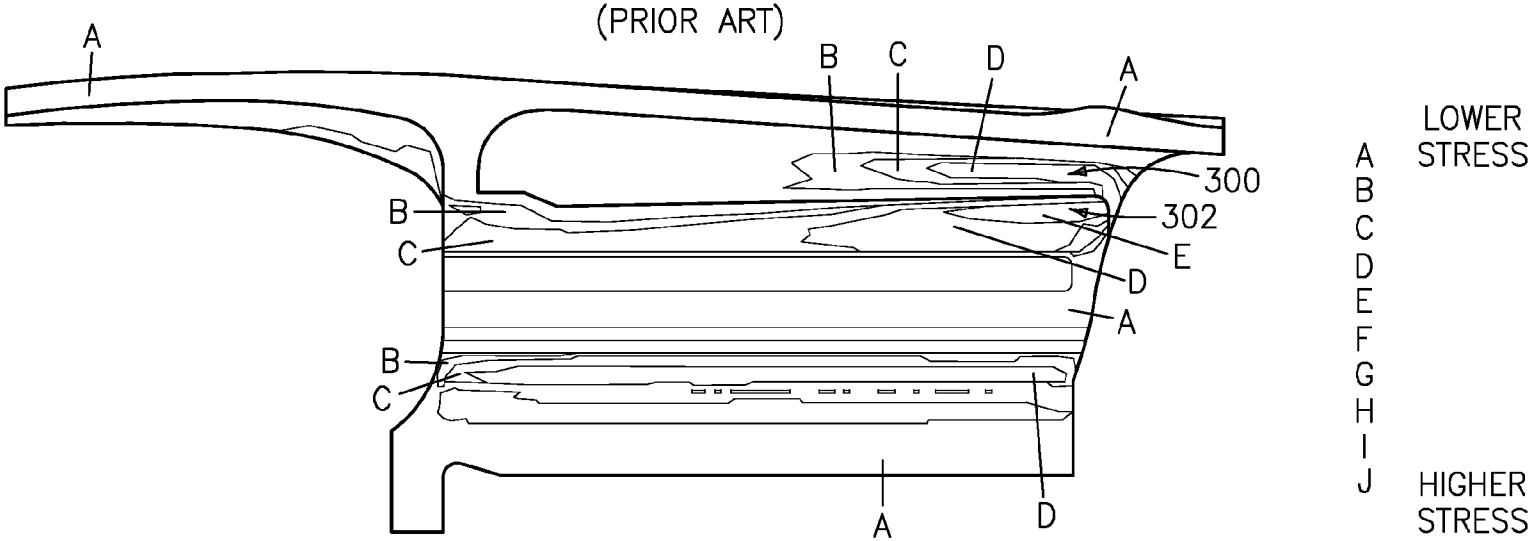
FIG. 11 illustrates the stresses acting on a turbine blade in accordance with the present invention.

FIG. 10 illustrates the stresses on the pressure side of a prior art turbine blade, particularly at the pressure side cast pocket 300. FIG. 11 illustrates the reduced stresses caused by the present invention. As can be seen from FIG. 11, the stress at the pressure side cast pocket 300 has been reduced by 42%. The stress at the pressure side machined fillet 302 has been reduced by 31%.

It is apparent that there has been provided in accordance with the present invention a turbine blade which fully satisfies the objects, means, and advantages set forth hereinbefore. While the present invention has been described in the context of specific embodiments thereof, other alternatives, modifications, and variations will become apparent to those skilled in the art. It is therefore intended to embrace those alternatives, modifications, and variations as fall within the broad scope of the appended claims.

What is claimed is:

1. A method for providing a turbine blade having balanced stress concentrations between suction and pressure sides comprising the step of:

forming a turbine blade having a platform, an attachment portion having a neck portion beneath the platform, an airfoil portion extending radially from said platform and overhanging a footprint of the attachment portion, and a maximum stress life limiting section located in an uppermost section of the neck portion just beneath said platform;

adjusting a moment towards a lower stress side of the neck portion; and said adjusting step comprising taking material away solely from the lower stress side of the limiting section.

2. The method according to claim 1, further comprising forming a compound fillet on a higher stress side trailing edge of a root of the attachment portion.

3. The method of claim 2, wherein said material removing step comprises forming an asymmetric neck portion.

4. A method for providing a turbine blade having balanced stress concentrations between suction and pressure sides comprising the step of:

forming a turbine blade having a platform, an attachment portion having a neck portion beneath the platform, and an airfoil portion extending radially from said platform;

adjusting a moment towards a lower stress side of the neck portion; and said adjusting step comprising adding material to the higher stress side of said neck portion.

5. A method for providing a turbine blade having balanced stress concentrations between suction and pressure sides comprising the step of:

forming a turbine blade having a platform, an attachment portion having a neck portion beneath the platform, and an airfoil portion extending radially from said platform;

adjusting a moment towards a lower stress side of the neck portion; and said adjusting step comprising taking material away from said lower stress side and adding material to said higher stress side of said neck portion to thereby form an asymmetric neck portion.

6. The method according to claim 5, wherein said adjusting step comprises taking material away from a suction side of said neck portion and adding material to a pressure side of said neck portion.

7. A method for providing a turbine blade having balanced stress concentrations between suction and pressure sides comprising the step of:

forming a turbine blade having a platform, an attachment portion having a neck portion beneath the platform, and an airfoil portion extending radially from said platform;

adjusting a moment towards a lower stress side of the neck portion;

dispersing strain in a region where the airfoil overhangs the neck portion; and said dispersing strain step comprising adding additional material at a rear root face of the attachment portion.

8. The method according to claim 7, wherein said rear root face has a substantially planar portion at a first end and said depositing step comprises adding said additional material beginning at a point spaced from said first end.

9. The method according to claim 8, wherein said adding step comprises adding said additional material so said additional material increases in thickness from said point space from said first end to a surface of said platform.

10. A method for providing a turbine blade having balanced stress concentrations between suction and pressure sides comprising the step of:

forming a turbine blade having a platform, an attachment portion having a neck portion beneath the platform, and an airfoil portion extending radially from said platform;

adjusting a moment towards a lower stress side of the neck portion;

dispersing strain in a region where the airfoil overhangs the neck portion; and said forming step comprising forming a neck portion edge having a planar portion, an arcuately shaped transition portion attached to said planar portion, and adding material at an end of said transition portion to form said compound fillet.

11. A turbine blade comprising:

a platform;

an airfoil radially extending from said platform;

an attachment portion comprising an asymmetric root neck having a higher stress side and a lower stress side;

said attachment portion having a footprint and said airfoil overhanging said footprint;

means for adjusting a moment towards the lower stress side of the neck; and said adjusting means comprising only said lower stress side of said attachment portion having material removed so as to form said asymmetric root neck.

12. The turbine blade of claim 11, wherein said higher stress side comprises a pressure side and said lower stress side comprises a suction side.

13. The turbine blade of claim 11, wherein said asymmetric root neck adjusts a moment of a volume above a limiting section center of gravity relative to a peak stress area center of gravity towards the lower stress side of the asymmetric root neck.

14. A turbine blade comprising:

a platform;

an airfoil radially extending from said platform;

an attachment portion comprising an asymmetric root neck having a higher stress side and a lower stress side;

said asymmetric root neck adjusting a moment of a volume above a limiting section center of gravity relative to a peak stress area center of gravity towards the lower stress side of the asymmetric root neck; and said asymmetric root neck being formed by material added to said higher stress side of said root neck.

15. A turbine blade comprising:

a platform;

an airfoil radially extending from said platform;

an attachment portion comprising an asymmetric root neck having a higher stress side and a lower stress side;

said asymmetric root neck adjusting a moment of a volume above a limiting section center of gravity relative to a peak stress area center of gravity towards the lower stress side of the asymmetric root neck; and said asymmetric root neck being formed by removing material from a lower stress side of said root neck and by adding material to a higher stress side of said root neck.

16. A turbine blade comprising:

a platform;

an airfoil radially extending from said platform;

an attachment portion comprising an asymmetric root neck having a higher stress side and a lower stress side; and said attachment portion having a forward root face and said root neck portion having an edge with a planar portion extending from said forward root face, an arcuately shaped transition region positioned adjacent an end of said forward root face, and a compound fillet extending from an end of said transition region.

17. The turbine blade according to claim 16, wherein said platform has a trailing edge and said compound fillet has a curved surface which extends from said end of said transition region to a point near an intersection of said higher pressure side and said trailing edge.

18. The turbine blade according to claim 17, wherein compound fillet increases in height from a point where said compound fillet intersects a surface of said platform and an elevated ridge.

19. A turbine blade comprising:

a platform;

an airfoil radially extending from said platform;

an attachment portion comprising an asymmetric root neck having a higher stress side and a lower stress side;

means for dispersing strain in a region where said airfoil overhangs said neck portion; and said attachment portion has a rear root face and said strain dispersing means comprises additional material formed on said rear root face.

20. The turbine blade according to claim 19, wherein said strain dispersing means further comprises a compound fillet on an end portion of a higher pressure side of said platform.

21. The turbine blade according to claim 19, wherein said rear root face has a planar portion and said additional material has a leading edge spaced from an edge of said planar portion.

22. The turbine blade according to claim 21, wherein said leading edge is arcuately shaped.

23. The turbine blade according to claim 21, wherein said additional material increases in thickness from said leading edge to a point adjacent a surface of said platform.

24. A turbine blade comprising:

a platform;

an airfoil radially extending from said platform;

an attachment portion including a neck portion and a higher pressure side; and means for dispersing strain in a region where said airfoil overhangs said neck portion; and said attachment portion having a rear root face and said strain dispersing means comprises additional material on said rear root face.

25. The turbine blade according to claim 24, wherein said rear root face has a planar portion beginning at a first end and said additional material extends from a leading edge spaced from said first end to a location where said additional material intersects an underside of said platform.

26. The turbine blade according to claim 25, wherein said additional material increases in thickness from said leading edge to said location.

27. The turbine blade according to claim 24, wherein said strain dispersing means further comprises a compound fillet at a higher stress side trailing edge of said attachment portion.

28. The turbine blade according to claim 27, wherein said compound fillet has a ridge and said compound fillet increases in thickness from a point where said compound fillet meets an underside of said platform to said ridge.

29. The turbine blade according to claim 28, wherein said attachment portion has a planar section and said strain dispersing means further comprises a curved transition section between said planar section and said compound fillet.

* * * * *